United States Patent [19]

Anderson

[11] 3,995,812

[45] Dec. 7, 1976

[54] ADJUSTMENT ASSEMBLY FOR SHOWER HEADS

[75] Inventor: Robert V. Anderson, Fort Worth, Tex.

[73] Assignee: Producers Specialty & Mfg. Co., Inc., Fort Worth, Tex.

[22] Filed: Aug. 13, 1975

[21] Appl. No.: 604,464

[52] U.S. Cl. ..... 239/458; 239/562

[51] Int. Cl.[2] ..... B05B 1/14

[58] Field of Search ..... 239/456–460, 239/107, 562

[56] References Cited

UNITED STATES PATENTS

| | | | |
|---|---|---|---|
| 2,657,955 | 11/1953 | Manning | 239/460 X |
| 2,790,677 | 4/1957 | Filliung et al. | 239/460 X |
| 3,254,842 | 6/1966 | Bachli et al. | 239/457 X |

*Primary Examiner*—John J. Love

*Attorney, Agent, or Firm*—Schmidt, Johnson, Hovey & Williams

[57] ABSTRACT

The spray pattern of a shower head may be varied by threading the faceplate of the head axially relative to its housing to change the effective cross-sectional areas of tapered grooves in pattern control elements which project through openings in the faceplate and which rotate as a unit with the faceplate during its manipulation. One embodiment has a mounting ring for the control elements which is rotatably retained on the central arbor of the head by a collar bonded to the tip end of the arbor. A second embodiment has a mounting ring for the elements which is threaded onto the exterior of the arbor in a manner to provide relative linear displacement between the faceplate and the elements when the faceplate is threaded into or out of the arbor, and a third embodiment utilizes a threaded collar at the tip end of the arbor to retain the freely rotatable mounting ring for the elements in place on the arbor. The faceplate of each of the three embodiments it telescopically received within the housing at its outlet, while a fourth embodiment has a faceplate that is disposed outside of the housing and telescopically receives the outlet thereof.

13 Claims, 7 Drawing Figures

ADJUSTMENT ASSEMBLY FOR SHOWER HEADS

This invention relates to a spray head such as for household showers, and has as an important object to provide a relatively inexpensive, yet trouble-free spray head in which the spray pattern may be quickly and easily adjusted.

Another important object of the present invention is to provide an adjustable pattern spray head as aforesaid wherein liquid issues from the head in essentially a "solid" spray with streams filling the interior of the spray instead of a "hollow" spray consisting of a ring of individual streams.

An additional important object of the instant invention is the provision of an adjustable pattern spray head in which the pattern control components thereof may be quickly and easily inserted into and removed from the head to facilitate assembly and maintenance operations.

A further important object of this invention is to provide an adjustable pattern spray head as set forth above in which the spray pattern may be manually adjusted from outside the spray streams issuing from the head to avoid physical contact with the streams during such adjustment.

Figure 1:
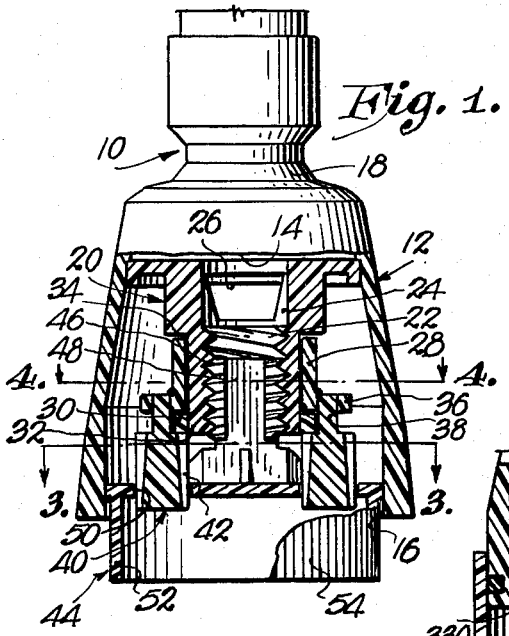
FIG. 1 is a fragmentary, elevational view of the spray head which embodies the principles of the present invention with the major components of the head partially broken away and shown in cross-section.
Figure 4:
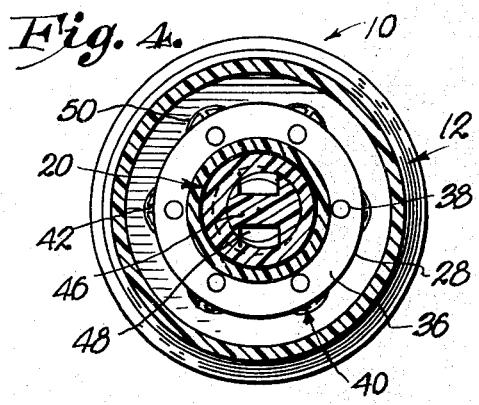
FIG. 4 is a cross-sectional view of the head taken along line 4—4 of FIG. 1.

The spray head 10 in FIG. 1 has a tubular housing 12 provided with a liquid inlet 14 at one end thereof and a liquid outlet 16 at the opposite end thereof. Inasmuch as head 10 is designed especially for use in household shower installations, housing 12 is essentially bell-shaped and is provided with a ball and socket adjusting support 18 at the end opposite outlet 16, although it is to be understood that such features are not critical to the concepts of the present invention.

Coaxially disposed within housing 12 is an arbor insert 20 which extends from inlet 14 toward outlet 16 and has a pair of adjoining, central bores 22 and 24 in flow communication with inlet 14. Bore 22 is internally threaded for a purpose which will hereinafter be described, while the bore 24 is smooth-walled with one or more peripherally disposed and circumferentially-spaced apertures 26 for introducing liquid, such as water, from inlet 14 into the main open area of housing 12.

A mounting ring structure 28 is loosely carried on arbor 20 for rotation thereabout by a collar structure 30 bonded at 32 arbor 20 by virtue of an adhesive or a sonic weld. The collar 30 thus provides a retaining seat for ring 28 to preclude undue movement of ring 28 in one axial direction, and a circular shoulder 34 on arbor 20 spaced from collar structure 30, limits movement of ring 28 in the opposite axial direction so that ring 28 is well confined against excessive movement along arbor 20 but is free to rotate thereabout.

Ring 28 has an outwardly projecting lip 36 which carries the stems 38 of six circularly disposed, spray pattern control elements 40. Each of the elements 40 is cylindrical in configuration and has a number of peripherally disposed, longitudinally tapered grooves 42 therein which progressively increase in size as the inlet 14 is approached. Each groove 42 is tapered in two directions, i.e., in depth as well as in width.

The outlet 16 of housing 12 is closed by an adjustable, cup-shaped faceplate 44 having a shank 46 which is threadably received by bore 22 for displacement of faceplate 44 axially of arbor 20 upon rotation of the faceplate 44. A pair of deep channels 48 on opposite sides of shank 46 communicate inlet 14 with the grooves 42 of elements 40, and six circularly arranged openings 50 in faceplate 44 slidably receive the corresponding elements 40 so that faceplate 44 may be shifted axially relative to the elements 40 which are disposed interiorly of the housing 12. Faceplate 44 is telescopically received within housing 12 and has an annular wall 52 which surrounds the elements 40 and projects outwardly therefrom through inlet 16 and beyond the same to present means outside the spray stream for manual manipulation of faceplate 44. The exterior surface 54 of wall 52 may be knurled or otherwise roughened to facilitate grasping thereof during adjustment, and wall 52 may be segmented if desired rather than continuous in nature.

In use, the pattern of the spray issuing from head 10 may be regulated by varying the rotative position of faceplate 44 to shift the same along grooves 42. If, for example, a relatively fine spray is desired, the faceplate 44 is disposed closely adjacent the outermost ends of grooves 42 wherein their flow capacities are smallest. The proximal portions of faceplate 44 cooperate with the grooves 42 at this position to severely restrict the liquid issuing from outlet 16. On the other hand, if a dense, heavy spray is desired, it is but necessary to rotate faceplate 44 in such a direction that shank 42 advances into bore 22 so that faceplate 44 exposes a greater cross-sectional area of the grooves 42. The nozzle-effect created in this position is appreciably less than that created when faceplate 44 is at the outer limit of its travel.

It is to be noted that faceplate 44 may be threaded into and out of bore 22 because of the free rotatability of elements 40 as a unit about arbor 20. When faceplate 44 is rotated, the elements 40 are carried along with faceplate 44 by the edges of openings 50 and yet, because of the threaded relationship between bore 22 and shank 46, faceplate 44 moves toward and away from inlet 14 to expose greater or lesser amounts of the grooves 42, depending upon the direction of rotation of faceplate 44.

It is to be appreciated that the mechanical interrelationship of the various components disposed within housing 12 is noncomplex, yet the desired degree of spray pattern control is readily achieved. Moreover, it will be appreciated that the entire head 10 may be fabricated from relatively inexpensive plastic material which may be easily bonded in place by a suitable adhesive or sonically welded if preferred. Further, by locating discharge means in the form of grooves 42 within the central area of housing 12 instead of relying merely upon an outer ring of discharge slots, a substantially "solid" spray is presented as opposed to a "hollow" spray. Therefore, the head 10 incorporates all of the desirable features of a spray head, yet at a substantially lower cost than has heretofore been possible.

Additionally, the special cupped shape of faceplate 44 with its annular wall 52 permits the spray pattern to be controlled while spray issues from head 10 without ever contacting the spray itself. Instead of reaching into the spray to twist finger tabs or the like on faceplate 44, it is but necessary to grasp the wall 52 outside of the spray and rotate faceplate 44 by this external means, thus allowing the spray to be adjusted before ever entering the shower and, further, preventing uncontrolled splattering of the streams in all directions which would occur if it were necessary to reach into the center of the spray to twist faceplate 44.

Figure 5:
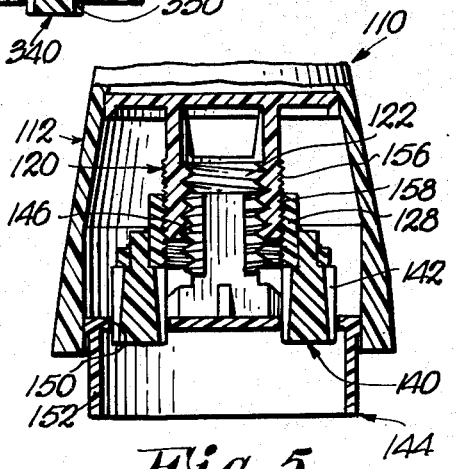
FIG. 5 is a view similar to FIG. 1 of a second embodiment of the spray head.
Figure 3:
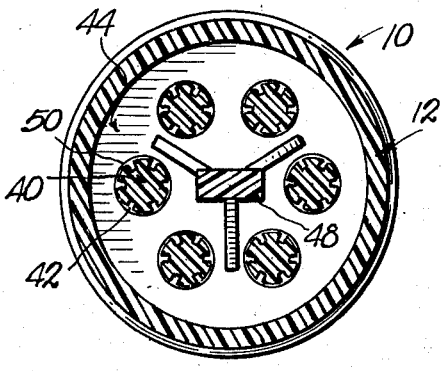
FIG. 3 is a cross-sectional view of the head taken along line 3—3 of FIG. 1.

FIG. 5 illustrates a second embodiment in which a spray head 110 is substantially similar to head 10 in construction and operation with the exception of the manner in which the pattern control elements 140 are mounted upon the arbor 120 within housing 112. To this end, the shank 146 of faceplate 144 is threadably received within the bore 122 of arbor 120 as in the first embodiment; however, the mounting ring 128 for elements 140 is threaded onto the exterior of arbor 120 instead of being loosely confined thereon as is the case with mounting ring 28 of the first embodiment. Moreover, the intermeshing threads 156 and 158 on arbor 120 and ring 128 respectively, have less pitch than their counterparts on the walls of bore 122 and shank 146 so that for the same amount of rotation, ring 128 is displaced a smaller distance along arbor 120 than the faceplate 144.

Adjustment of the spray issuing from head 110 is obtained in the same manner as with head 10, i.e., by rotating faceplate 144 through wall 152 in the direction necessary to produce either a fine spray or a strong, heavy spray, depending upon individual preference. As faceplate 144 is rotated, the elements 140 are also forced to rotate in the same direction by the edges of openings 150 in faceplate 144, hence threading shank 146 into or out of bore 122 and ring 128 further on or off of arbor 120, depending upon the direction of rotation. Relative displacement between the faceplate 144 and elements 140 is obtained, however, by virtue of the pitch differential as above set forth between ring 128 and shank 146 such that variable amounts of the grooves 142 are exposed to modify the nozzle effect created.

Figure 6:
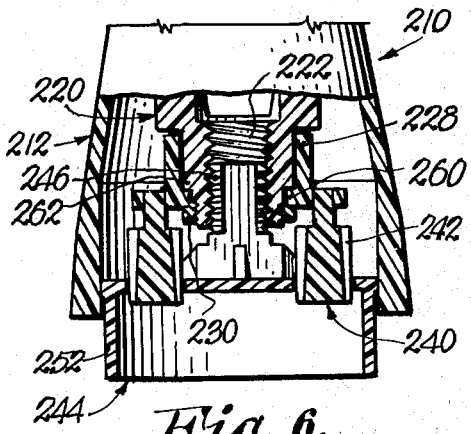
FIG. 6 is a view similar to FIGS. 1 and 5 of a third embodiment of the spray head.

FIG. 6 shows a third embodiment of the invention wherein head 210 is again substantially similar to head 10 with the exception of the manner in which the spray pattern control elements 240 are mounted upon the arbor 220 within housing 212. In this embodiment, the shank 246 of faceplate 244 is again threadably received in the bore 222 of arbor 220, and the mounting ring 228 is freely rotatable on arbor 220 as is the case with ring 28. However, instead of the retaining collar 30 of the first embodiment which is glued or sonically welded in place, the embodiment of FIG. 6 contemplates the use of an internally threaded collar 230 which is threaded onto the tip of arbor 220 for retention thereby. An inwardly extending projection 260 of ring 228 loosely rides on collar 230 and is confined against movement in the opposite direction along arbor 220 by an abutment 262.

In use, adjustment of the spray pattern is carried out in an identical manner to that of heads 10 and 110, i.e., by rotating the faceplate 244 through wall 252 in the appropriate direction to shift the same relative to the grooves 242. In this embodiment, elements 240 do not travel along arbor 220 as is the case in head 110, but instead, only rotate about the same freely as with head 10. It will be appreciated that disassembly and reassembly of the components of head 210 (as well as those of head 110) may be quite easily carried out by simply unscrewing the various components from one another and then returning them to their normal threaded relationships.

Figure 7:
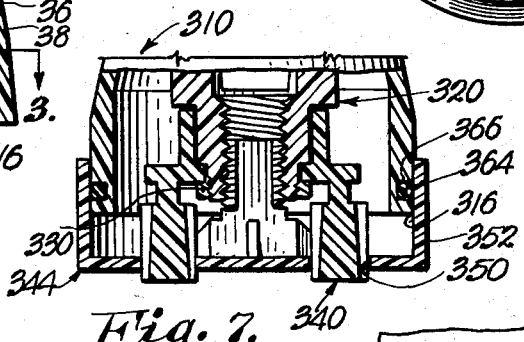
FIG. 7 is a view similar to FIG. 6 of a fourth embodiment of the spray head.
Figure 2:
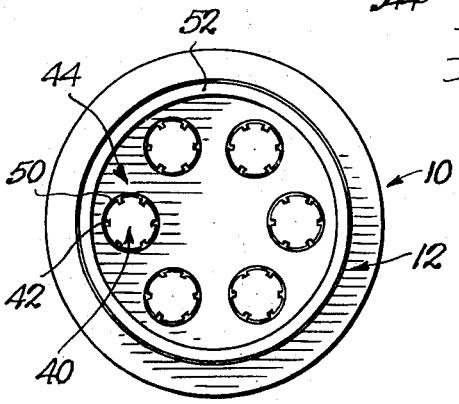
FIG. 2 is an elevational view of the outlet end of the spray head.

FIG. 7 depicts a fourth and in many instances, preferred, embodiment of the invention in which head 310 is similar to head 210 in that the internally threaded collar 330 is threaded onto the top of the arbor 320 for retention thereby; however, the cup-shaped faceplate 344 is reversed relative to housing 312 and located outwardly thereof rather than inverted and telescopically received therewithin. In this instance, wall 352 is disposed circumferentially of the housing 312 and extends upwardly to overlap the same which has been shortened relative to the arbor 320 and the spray control elements 340 such that the latter now project beyond the outlet 316 for extension through the openings 350 of faceplate 344. An 0-ring seal 364 is seated in an external groove 366 located in the housing 312 adjacent outlet 316.

Adjustment of the spray pattern is carred out in an identical manner to that of the aforedescribed heads 10, 110, and 210, i.e., by rotating the faceplate 344 through wall 352 in the opposite direction to shift the same relative to the grooves 342. The elements 340 freely rotate about the arbor 320 the same as is the case in head 210, the only difference being that in head 310 the faceplate 344 is located outwardly of the housing 312 rather than interiorly thereof. In any event the means for adjusting the faceplate 344 are disposed radially outside of the spray elements 340 thereby permitting regulation of the spray pattern without contacting the spray.

Having thus described the invention, what is claimed as new and desired to be secured by Letters Patent is:

1. An adjustable spray head comprising:

a tubular housing having a liquid inlet at one end and a liquid outlet at the opposite end;

a plurality of spray pattern control elements each having at least one peripherally disposed, longitudinally tapering, liquid flow groove therein;

structure circularly mounting said elements within said housing for rotation as a unit about a common axis extending between said inlet and said outlet with said grooves extending longitudinally of said axis;

a faceplate having a plurality of circularly spaced openings therein for said elements;

a tubular arbor concentrically disposed within said housing and having an open outermost extemity, said arbor being internally threaded adjacent said extremity and for a distance inwardly therefrom; and a shank projecting normally from said faceplate in concentric relationship to the circle of openings therein, said shank being externally threaded and matingly received within said arbor, said structure including a ring surrounding said arbor and means mounting said ring on the exterior of the arbor adjacent said extremity for rotation relative to the latter, said ring carrying said elements in registration with said openings for projection through the latter a variable amount in response to threading the shank into or out of said arbor.

2. A spray head as claimed in claim 1, wherein said rotational mounting means includes means defining a retaining seat on the outside of said arbor, said ring loosely riding on said seat.

3. A spray head as claimed in claim 2, wherein said arbor is provided with means defining a shoulder spaced axially from said seat and cooperating with the seat to confine the mounting ring.

4. A spray head as claimed in claim 2, wherein said seat-defining means comprises a collar surrounding said arbor and bonded thereto.

5. A spray head as claimed in claim 2, wherein said seat-defining means comprises a collar surrounding said arbor and threadably secured thereto.

6. A spray head as claimed in claim 1, wherein said ring is threadably secured to the exterior of said arbor, the threads on said shank having a different pitch than those on said ring to provide relative displacement between the faceplate and the elements upon rotation of the faceplate.

7. A spray head as claimed in claim 6, wherein the pitch of the threads on said shank is greater than that of the threads on said ring.

8. A spray head as claimed in claim 1, wherein said faceplate is provided with manual adjustment means disposed radially outside of said elements and projecting beyond said outlet for manipulation of the faceplate without contacting the spray.

9. A spray head as claimed in claim 8, wherein said faceplate is cup-shaped, said adjustment means comprising annular wall means about the group of said elements.

10. A spray head as claimed in claim 9, wherein the outer surface of said wall means is roughened to facilitate grasping thereof.

11. A spray head as claimed in claim 9, wherein said faceplate is telescopically received within said housing at said outlet, said faceplate being inverted such that said wall means project outwardly beyond said outlet and said elements.

12. A spray head as claimed in claim 9, wherein said faceplate is located outside of said housing at said outlet with said wall means being disposed circumferentially of said housing such that the latter is telescopically received therewithin.

13. A spray head as claimed in claim 12, wherein said elements project beyond said outlet for extension through said faceplate.

* * * * *